United States Patent [19]

Suska

[11] 4,351,085

[45] Sep. 28, 1982

[54] NON-HANDED TWO KNUCKLE HINGE

[75] Inventor: Charles R. Suska, Roxbury, Conn.

[73] Assignee: The Stanley Works, New Britain, Conn.

[21] Appl. No.: 905,778

[22] Filed: May 15, 1978

[51] Int. Cl.[3] ..... E05D 7/02; E05F 1/12

[52] U.S. Cl. ..... 16/273; 16/380; 16/304

[58] Field of Search ..... 16/168, 169, 170, 189, 16/176, DIG. 33, 136

[56] References Cited

U.S. PATENT DOCUMENTS

| | | | |
|---|---|---|---|
| 196,791 | 11/1877 | Fahnestock et al. | 16/170 |
| 793,703 | 7/1905 | Williams | 16/136 X |
| 3,390,420 | 7/1968 | Foltz | 16/169 |
| 3,545,032 | 12/1970 | Dielman | 16/169 X |
| 3,999,246 | 12/1976 | Suska | 16/189 X |
| 4,135,273 | 1/1979 | Holmes | 16/169 |

FOREIGN PATENT DOCUMENTS

| | | | |
|---|---|---|---|
| 249080 | 3/1948 | Switzerland | 16/168 |
| 928795 | 6/1963 | United Kingdom | 16/168 |

*Primary Examiner*—Peter P. Nerbun

*Attorney, Agent, or Firm*—Brumbaugh, Graves, Donohue & Raymond

[57] ABSTRACT

A two knuckle hinge has a pair of vertical bearings so that the hinge can be used interchangeably in left-handed and right-handed door installations.

30 Claims, 3 Drawing Figures

NON-HANDED TWO KNUCKLE HINGE

BACKGROUND OF THE INVENTION

The handedness of a particular door installation is determined by the direction in which the door pivots when moved from a closed position to an open position. If a door must be pivoted in a counterclockwise direction to open it, the door installation is considered to be left-handed. In a right-handed door installation, the door is pivoted in a clockwise direction to open it. Left-handed doors are hung from a jamb using a left-handed hinge, unless a non-handed hinge is employed. Similarly, either a right-handed hinge or a non-handed hinge may be used in right-handed door installations.

In FIG. 3 of my U.S. Pat. No. 3,903,567, there is illustrated a two knuckle hinge comprising a pair of adjacent hinge leaves on which short and long axially aligned hinge knuckles, respectively, are formed. A pintle, about which the long hinge knuckle pivots, is supported in the short hinge knuckle and extends into the long hinge knuckle. The pintle includes an external flange located in the end of the short hinge knuckle adjacent the long hinge knuckle for providing an anti-friction surface for a bushing and for preventing the pintle from being driven out of either hinge knuckle.

In mounting a door from a jamb, the leaf with the short hinge knuckle must be attached to the jamb so that the short hinge knuckle and the pintle will actually support the rest of the hinge assembly. Because the hinge has only a single vertical load or thrust bearing, i.e., the bushing which engages the flange on the pintle, if the leaf with the short hinge knuckle were attached to the door, rather than the jamb, with the long hinge knuckle positioned above the short hinge knuckle, the weight of the door would tend to separate the hinge knuckles, rendering the thrust bearing ineffective and possibly pulling the pintle out of the long hinge knuckle.

By applying the above-described principles for determining the handedness of a hinge, it can be determined that the two knuckle hinge illustrated in FIG. 3 of my U.S. Pat. No. 3,903,567 is left-handed, and, therefore, it cannot be used in right-handed door installations. Thus, handed two knuckle hinges, whether right-handed or left-handed, are restricted solely for use in similarly handed door installations.

SUMMARY OF THE INVENTION

To benefit from the advantages that non-handed hinges, i.e., hinges which can be used interchangeably in left-handed and right-handed door installations, have over handed hinges, there is provided, in accordance with the present invention, a non-handed two knuckle hinge including a pair of axially aligned hinge knuckles formed respectively on adjacent edges of two hinge leaves. One hinge knuckle rotates about a pintle which is nonrotatably supported in the other hinge knuckle by, for example, a cross pin, which also fixes the axial position of the pintle in the other hinge knuckle. The portion of the pintle extending into the bore of the one hinge knuckle has an external flange positioned above an internal shoulder formed in the bore of the one hinge knuckle.

By this construction, if the leaf formed with the one hinge knuckle is attached to a door in, for example, a conventional right-handed door installation, the other hinge knuckle and the pintle will support the rest of the hinge assembly, the surface of the other hinge knuckle which interfaces with the one hinge knuckle forming a vertical load bearing. In left-handed door installations, the leaf formed with the one hinge knuckle may be attached to the jamb, because the flange on the pintle engages the shoulder in the bore of the one hinge knuckle to form another vertical load bearing which prevents separation of the hinge knuckles. In addition to preventing the inadvertent disassembly of the hinge, the flange also provides greater security by preventing the pintle from being driven out of the other hinge knuckle.

Each of the vertical load bearings may be provided with a corresponding anti-friction element to reduce the torque required to open and close a door hung from a jamb using the new and improved non-handed hinge, thereby increasing the life expectancy of the hinge. In one embodiment of the invention, both of the anti-friction elements are washers made from an anti-friction material, one washer for each vertical load bearing. In another embodiment, one of the anti-friction elements is an external flange on an anti-friction bushing located in the inner end of the one hinge knuckle, the other anti-friction element being an anti-friction washer or an external flange on another anti-friction bushing. In either embodiment, a smooth or polished metallic washer may be interposed between the hinge knuckles in contact with one of the anti-friction elements to reduce the abrasion between the element and the inner end of the other hinge knuckle.

A torsion spring mechanism may be positioned in the one hinge knuckle for urging the hinge leaves together. One end of the torsion spring mechanism is fastened to the pintle. A capstan or plug is provided in the outer end of the one hinge knuckle to nonrotatably fix the other end of the torsion spring mechanism in the one hinge knuckle. The capstan also can be designed to permit field adjustment of the tension on the torsion spring mechanism. Inasmuch as the torsion spring mechanism always urges the hinge leaves toward each other and the hinge is provided with a pair of vertical load bearings, the non-handed hinge of the present invention may be used interchangeably in right-handed and left-handed door installations and inverted in either installation without affecting the operation of the hinge.

The two knuckle hinge of the present invention may simulate a three or more knuckle hinge by making the hinge knuckles unequal in length. A marking, such as a groove which simulates the gap between knuckles, is provided around the exterior of the long hinge knuckle at a distance from its outer end equal to the length of the short hinge knuckle. Additional markings can be used to simulate hinges with a greater number of knuckles.

BRIEF DESCRIPTION OF THE DRAWING

For a better understanding of the invention, reference may be made to the following description of an exemplary embodiment, taken in conjunction with the figures of the accompanying drawings, in which.

DESCRIPTION OF AN EXEMPLARY EMBODIMENT

While the present invention is applicable to almost any type of two knuckle hinge, it is especially suitable for spring hinges. Thus, the invention will be described with particular reference to a two knuckle hinge of the spring-operated type.

Figure 1:
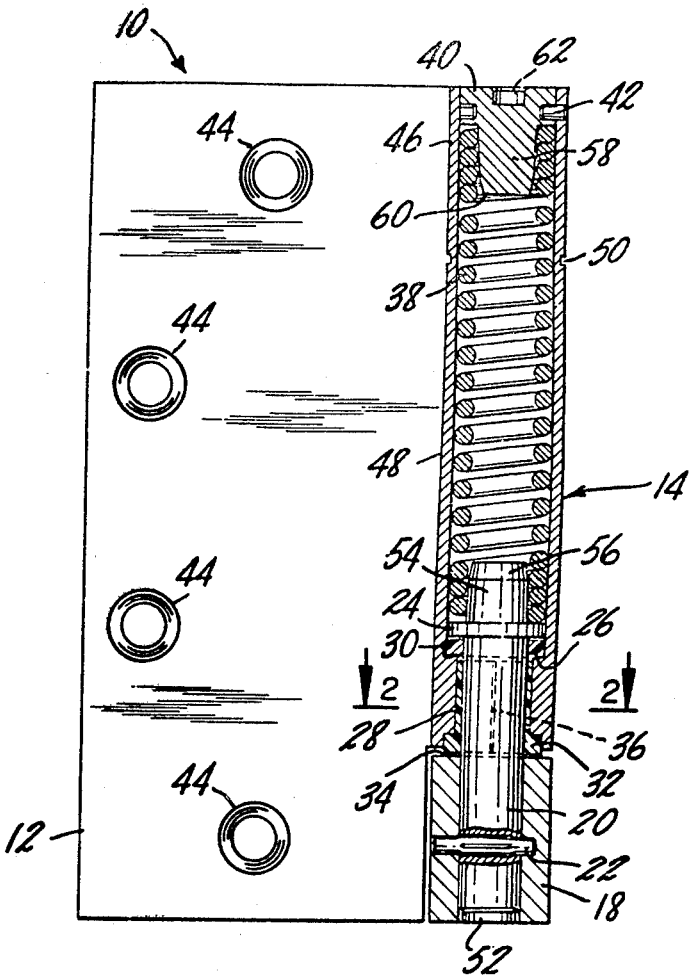
FIG. 1 is an elevational view of one embodiment of the non-handed two knuckle hinge of the present invention, a portion of the hinge barrel being cut away to better illustrate the present invention.
Figure 2:
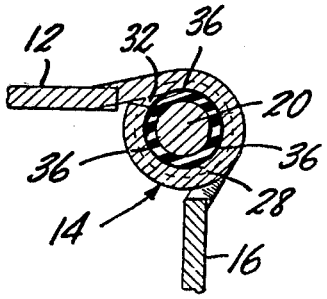
FIG. 2 is a cross-sectional view, taken along the line 2—2 of FIG. 1 and looking in the direction of the arrows, of the hinge illustrated in FIG. 1.
Figure 3:
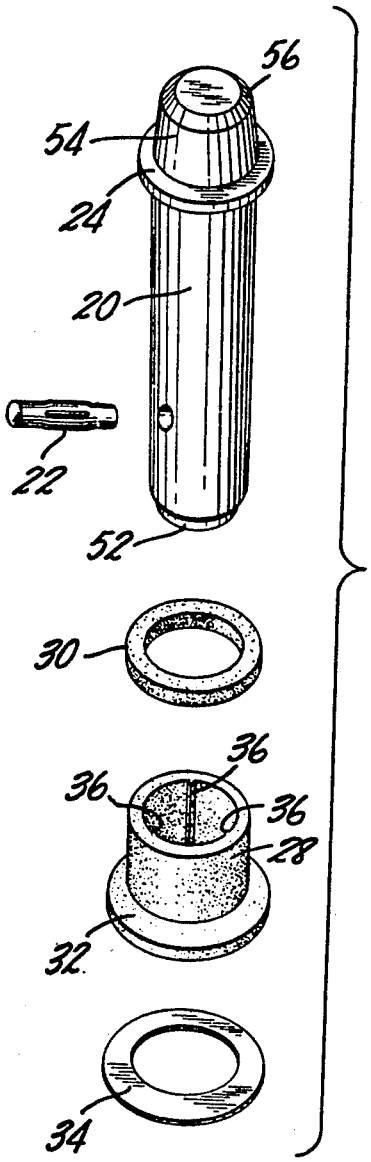
FIG. 3 is an exploded view of the pintle and bearing assembly of the hinge of FIGS. 1 and 2.

Referring generally to FIGS. 1–3, a spring hinge 10 embodying the present invention is shown . The spring hinge 10 comprises a first hinge leaf 12 with a long hinge knuckle 14 and a second hinge leaf 16 with a short hinge knuckle 18. A pintle 20, about which the long hinge knuckle 14 pivots, is supported in the short hinge knuckle 18. Alternatively, the hinge knuckles 14 and 18 can have equal lengths. The advantages of unequal length hinge knuckles are stated in my U.S. Pat. No. 3,903,567, the specification of which is hereby incorporated herein by reference.

A cross pin 22, extending through radially aligned holes in the pintle 20 and the short hinge knuckle 18, anchors the pintle 20 against rotation in the short hinge knuckle 18 and against axial movement. An external flange 24, extending radially outwardly from the pintle 20, is positioned in the bore of the long hinge knuckle 14 above a radially inwardly extending shoulder 26 formed therein. The shoulder 26 is preferably formed unitarily with the long hinge knuckle 14.

To enable free pivoting of the hinge leaves 12 and 16, the lower portion of the long hinge knuckle 14 is adapted to receive a bushing 28 and a washer 30, both of which are made from an anti-friction material, such as plastic. The bushing 28 is essentially a tubular member having at its lower end a radially outwardly extending flange 32, which bears against a washer 34 circumscribing the pintle 20 and abutting the short hinge knuckle 18, the washer 34 presenting a smooth bearing surface for the flange 32 of the bushing 28. The end of the long hinge knuckle 14 adjacent the short hinge knuckle 18 is counterbored to accomodate the flange 32 of the bushing 28. The internal surface of the bushing 28 has ridges 36 which bear directly on the outer radial surface of the pintle 20, the ridges 36 permitting the manufacturing tolerances for the diameter of the pintle 20 to be increased. Besides providing a thrust bearing surface for the pintle 20 when a door is hung from the hinge leaf 12, the bushing 28 also provides a lateral bearing surface for the pintle 20. If the hinge 10 were inverted to position the short hinge knuckle 18 above the long hinge knuckle 14, the flange 32 of the bushing 28 also provides a thrust bearing surface when the door is hung from the hinge leaf 16.

When the door is hung from the hinge leaf 16, with the long hinge knuckle 14 positioned above the short hinge knuckle 18 (see FIG. 1), the washer 30, which is seated on the shoulder 26 immediately below the flange 24, provides a thrust bearing surface for the pintle 20. If the outer diameter of the washer 30 is substantially equal to the inner diameter of the long hinge knuckle 14 and the inner diameter of the washer 30 is substantially equal to the outer diameter of the pintle 20, the washer 30 will provide a lateral bearing surface also. In an inverted position with the short hinge knuckle 18 above the long hinge knuckle 14, the washer 30 also provides a thrust bearing surface when the hinge leaf 16 is attached to the jamb.

As will be further explained hereinafter, the bore of the long hinge knuckle 14 receives a torsion spring 38 which typically may be a coil spring. The spring 38, by its attachment at one end to the pintle 20 and at the other end to a capstan 40 anchored in the upper end of the long hinge knuckle 14 by a small pin 42, tends to urge the hinge leaves 12 and 16 together. Thus, a door supported by the hinge 10 is resiliently urged to its closed position.

To make the spring hinge 10 of the present invention, the hinge leaf 16 is formed from a strong material, such as steel. A series of countersunk mounting holes (not shown), adapted to receive screws, are drilled in the hinge leaf 16. The short hinge knuckle 18, having a length substantially equal to that of an end knuckle of a like-sized three knuckle concealed bearing hinge, is formed at the lowermost edge of the hinge leaf 16.

The hinge leaf 12, formed from the same material as the hinge leaf 16, also is provided with a series of countersunk mounting holes 44 adapted to receive screws, the openings 44 thereby providing attachment means for the leaf. Formed as part of the uppermost portion of the hinge leaf 12 is the long hinge knuckle 14, having a length substantially equal to that of an end knuckle and a middle knuckle of a like-sized three knuckle concealed bearing hinge.

To simulate a three knuckle hinge, the long hinge knuckle 14 is divided into a simulated upper hinge knuckle 46 and a simulated middle hinge knuckle 48 by a groove 50 simulating the gap between knuckles. It should be understood that additional markings may be used to simulate hinges with, for example, five knuckles. The design and construction of the groove 50 are discussed in detail in my U.S. Pat. No. 3,903,567, the specification of which has been incorporated herein by reference.

To assemble the hinge 10, the washer 30 is slid into the bore of the long hinge knuckle 14 until it engages the shoulder 26. The pintle 20 is then inserted into the long hinge knuckle 14 until the flange 24 engages the washer 30, the reduced diameter portion 52 at the lower end of the pintle 20 facilitating the insertion thereof. The bushing 28 can then be slid over the portion of the pintle 20 extending outwardly from the long hinge knuckle 14 until the flange 32 seats in the counterbore formed in the lower end of the long hinge knuckle 14. After the washer 34 is slipped over the exposed end of the pintle 20, the short hinge knuckle 18 can be slid onto the exposed end of the pintle 20 until the washer 34 is sandwiched between the flange 32 of the bushing 28 and the adjacent end of the short hinge knuckle 18. The pintle 20 is then nonrotatably anchored in the short hinge knuckle 18 by inserting the cross pin 22 through a hole in the short hinge knuckle 18 and into a radial bore in the pintle 20. With the pintle 20 in place, the spring 38 can be pressed onto the pintle 20 and the capstan 40.

The spring 38 includes several closed turns at each end for providing maximum gripping effect on the capstan 40 and the pintle 20. By utilizing a spring wound in a direction appropriate to the direction in which the hinge 10 opens, the spring grips the capstan 40 and the pintle 20 with increasing force as the spring torsion increases.

The spring 38 is positively secured to the pintle 20 by providing the end of the pintle 20 extending into the long hinge knuckle 14 with a taper 54, the large diameter portion of which engages and expands the closed turns at the lower end of the spring 38. The small diameter portion of the taper 54 and a chamfer 56 at the end of the small diameter portion facilitate insertion of the spring 38 onto the pintle 20. After the spring 38 is forced onto the pintle 20, the winding of the spring 38 causes it to more tightly grip the large diameter portion of the taper 54.

When the spring 38 has been wound to the desired torque value, the capstan 40 is secured in place by the pin 42 which can be slip fitted through radially aligned holes in the long hinge knuckle 14 and the capstan 40. The capstan 40, like the pintle 20, may be provided with a taper 58 having a large diameter portion for securing the spring 38 to the capstan 40. The small diameter portion of the taper 58 and a chamfer 60 at the end of the small diameter portion facilitate insertion of the capstan 40 into the upper end of the spring 38, the large diameter portion of the taper 58 of the capstan 40 engaging and expanding the closed turns at the upper end of the spring 38.

To wind the spring 38, the hinge leaf 16 is held while a drive device cooperating with a recess 62 in the capstan 40 is used to rotate the capstan 40. After the spring 38 has been wound to the desired torque value, the pin 42 is inserted in the manner discussed above. The torque on the pin 42 created by the torsion of the spring 38 prevents its inadvertent movement. The number of radial holes provided in the capstan 40 depends upon the fineness of torsional adjustment desired. However, if a spring hinge adapted for field adjustment is not desired, the pin 42 may be secured, for instance, by welding, in a single radial hole in the capstan 40 to permanently set the desired torque value of the spring 38.

In operation in a left-handed door installation, the hinge leaf 16 with the short hinge knuckle 18 is attached to a jamb and the other hinge leaf 12 is attached to a door in such a manner that the short hinge knuckle 18 is positioned above the long hinge knuckle 14. Thus, the short hinge knuckle 18 and the pintle 20 actually support the rest of the hinge 10, the flange 24 and the washer 30 forming a thrust bearing. Alternatively, in operation in a left-handed door installation, the hinge leaf 12 with the long hinge knuckle 14 is attached to the jamb and the other hinge leaf 16 is attached to the door in such a manner that the long hinge knuckle 14 is positioned above the short hinge knuckle 18. Thus, the long hinge knuckle 14 actually supports the rest of the hinge 10, the flange 24 engaging the washer 30 in the bore of the long hinge knuckle 14 to form a thrust bearing which prevents separation of the hinge knuckles 14, 18.

For use in a right-handed door installation, the hinge leaf 16 with the short hinge knuckle 18 is attached to the door and the other hinge lead 12 is attached to the jamb in such a manner that the short hinge knuckle 18 is positioned above the long hinge knuckle 14. The washer 34 bears against the flange 32 of the bushing 28 to form a thrust bearing. Alternatively, in operation in a right-handed door installation, the hinge leaf 16 with the short hinge knuckle 18 is attached to the jamb and the other hinge leaf 12 is attached to the door in such a manner that the long hinge knuckle 14 is positioned above the short hinge knuckle 18. The flange 32 of the bushing 28 and the washer 34 form a thrust bearing.

Of course, the short hinge knuckle 18 could be attached to the lower portion of the hinge leaf 12, rather than the hinge leaf 16, with the long hinge knuckle 14 being attached to the upper portion of the hinge leaf 16, rather than the hinge leaf 12. With this type of hinge construction, the washer 34 and the flange 32 of the bushing 28 would form a thrust bearing in left-handed door installations, while the flange 24 of the pintle 20 and the washer 30 would form a thrust bearing in right-handed door installations.

It will be understood that the above described embodiment is merely exemplary and that those skilled in the art may make many variations and modifications without departing from the spirit and scope of the invention. For example, the flanged bushing 28 may be replaced by a washer and bushing combination, whereby the anti-friction means consists of three separate elements instead of two separate elements. Alternatively, a second flanged bushing can be used in place of the washer 30. Of course, the various bushing-washer-shoulder or bushing-bushing-shoulder combinations described above can be replaced by a single metal bushing made of, for example, bronze and nonrotatably fixed within the long hinge knuckle 14 in a generally coaxial relationship therewith by any suitable method, such as brazing, soldering or pinning. The length of the metal bushing would be approximately equal to the combined length of the bushing 28 and washer 30. The outer diameter of the metal bushing should be substantially equal to the inner diameter of the long hinge knuckle 14 which can be uniform along the entire length of the long hinge knuckle 14. The metal bushing would also have an inner diameter substantially equal to the diameter of the pintle 20. All such modifications and variations are intended to be within the scope of the invention as defined in the appended claims.

I claim:

1. A non-handed two knuckle hinge comprising a pair of adjacent hinge leaves, a pair of axially aligned hinge knuckles formed respectively on the adjacent edges of said hinge leaves, an axially extending bore in each said knuckle, attachment means for the leaves adapted to be used to attach them to a door and jamb, one of the hinge leaves adapted to be attached to either of said door or jamb and the other of said hinge leaves adapted to be attached to the other of said door or jamb, a pintle, about which one of said hinge knuckles pivots, supported in the bore of the other of said hinge knuckles against axial movement, a flange on said pintle located in said bore of said one hinge knuckle, an internal shoulder formed in the bore of said one hinge knuckle between said flange and said other hinge knuckle to form with said flange a thrust bearing for said hinge, and thrust bearing surfaces on the abutting ends of said hinge knuckles to form another thrust bearing for the hinge, whereby the hinge may be used interchangeably in left-handed and right-handed door installations and inverted in either type of installation without affecting the operation of the hinge.

2. A hinge according to claim 1, wherein said shoulder is located between said flange and said other hinge knuckle.

3. A hinge according to claim 2, further comprising first anti-friction means between said shoulder and said flange for providing an anti-friction thrust bearing for the hinge, and second anti-friction means interposed between said hinge knuckles to provide another anti-friction thrust bearing for said hinge.

4. A hinge according to claim 3, wherein at least one of said first and second anti-friction means is a washer made from an anti-friction material.

5. A hinge according to claim 4, wherein both of said first and second anti-friction means are washers made from an anti-friction material.

6. A hinge according to claim 5, further comprising an anti-friction bushing disposed about said pintle in said one hinge knuckle between said washers, said bushing acting as a lateral bearing for said hinge.

7. A hinge according to claim 4, wherein one of said first and second anti-friction means is a flange on an anti-friction bushing disposed about said pintle in said one hinge knuckle, said bushing acting as a lateral bearing for said hinge.

8. A hinge according to claim 3, wherein each of said first and second anti-friction means is a flange on a corresponding one of a pair of anti-friction bushings disposed about said pintle in said one hinge knuckle, said pair of bushings acting as a lateral bearing for said hinge.

9. A hinge according to claim 3, further comprising a washer disposed about said pintle between said second anti-friction means and said other hinge knuckle for presenting a nonabrasive surface to said second anti-friction means.

10. A hinge according to claim 3, further comprising a torsion spring mechanism in said one hinge knuckle for urging said hinge leaves together, means for nonrotatably fixing one end of said torsion spring mechanism remote from said other hinge knuckle in said one hinge knuckle, means for fastening said pintle to the other end of said torsion spring mechanism, and means for nonrotatably supporting said pintle in said other hinge knuckle.

11. A hinge according to claim 1, wherein said shoulder is formed by a bushing positioned within the bore of said one hinge knuckle generally coaxially therewith.

12. A hinge according to claim 11, further comprising fastening means for nonrotatably fixing said bushing in said bore of said one hinge knuckle.

13. A hinge according to claim 11, wherein said bushing is made from bronze.

14. A non-handed two knuckle hinge comprising upper and lower axially aligned hinge knuckles formed respectively on adjacent edges of two hinge leaves, an axially extending bore in each said knuckle, attachment means for the leaves adapted to be used to attach them to a door and a jamb, one of the hinge leaves adapted to be attached to either of said door or jamb and the other of said hinge leaves adapted to be attached to the other of said door or jamb; a pintle, about which one of said hinge knuckles pivots, supported in the other of said hinge knuckles against axial movement; first bearing means formed between the hinge knuckles for acting as an axial thrust bearing in a direction of said one knuckle toward said other knuckle when a door is attached to the leaf associated with said upper hinge knuckle; and second bearing means formed in the bore of said one hinge knuckle for acting as an axial thrust bearing in a direction, opposite to said first bearing means, of said one knuckle away from said other knuckle when a door is attached to the leaf associated with said lower hinge knuckle, whereby said hinge may be used interchangeably in left-handed and right-handed door installations and inverted in either type of installation without affecting the operation of the hinge.

15. A hinge according to claim 14, wherein at least one of said first and second bearing means includes an anti-friction washer.

16. A hinge according to claim 15, wherein each of said first and second bearing means includes an anti-friction washer.

17. A hinge according to claim 16, further comprising another washer, disposed about said pintle between the anti-friction washer of said second bearing means and said other hinge knuckle, for presenting a nonabrasive surface to said anti-friction washer.

18. A hinge according to claim 16, further comprising an anti-friction bushing disposed about said pintle in said one hinge knuckle between said washers, said bushing acting as a lateral bearing for said hinge.

19. A hinge according to claim 15, wherein one of said first and second bearing means includes a flange on an anti-friction bushing disposed about said pintle in said one hinge knuckle, said bushing acting as a lateral bearing for said hinge.

20. A hinge according to claim 14, wherein each of said first and second bearing means includes a flange on a corresponding one of a pair of anti-friction bushings disposed about said pintle in said one hinge knuckle, said pair of bushings acting as a lateral bearing for said hinge.

21. A hinge according to claim 20, further comprising a washer, disposed about said pintle between the flange of said second bearing means and said other hinge knuckle, for presenting a nonabrasive surface to said flange.

22. A hinge according to claim 14, further comprising a torsion spring mechanism in said one hinge knuckle for urging said hinge leaves together, means for nonrotatably fixing one end of said torsion spring mechanism remote from said other hinge knuckle in said one hinge knuckle, means for fastening said pintle to the other end of said torsion spring mechanism, and means for nonrotatably supporting said pintle in said other hinge knuckle.

23. A non-handed two knuckle spring hinge comprising a pair of adjacent hinge leaves, long and short axially aligned hinge knuckles formed respectively on adjacent edges of said leaves; an anti-friction bushing in the end of said long hinge knuckle adjacent said short hinge knuckle, said bushing including an external flange positioned between said hinge knuckles; a torsion spring mechanism in said long hinge knuckle for urging said hinge leaves together; means for nonrotatably fixing one end of said torsion spring mechanism remote from said short hinge knuckle in the end of said long hinge knuckle; a pintle, about which said long hinge knuckle pivots, nonrotatably supported in said short hinge knuckle and extending through said bushing in said long hinge knuckle, said pintle having means for fastening said pintle to the other end of said torsion spring mechanism and an external flange located in said long hinge knuckle; a shoulder in the long hinge knuckle positioned a distance from said flange of said pintle; and an anti-friction washer disposed about said pintle between said flange of said pintle and said shoulder.

24. A hinge according to claim 23, further comprising a smooth metallic washer interposed between said flange of said bushing and said short hinge knuckle.

25. A non-handed two knuckle spring hinge comprising a pair of adjacent hinge leaves, long and short axially aligned hinge knuckles formed respectively on adjacent edges of said leaves; a first anti-friction bushing in the end of said long hinge knuckle adjacent said short hinge knuckle, said first anti-friction bushing including an external flange positioned between said hinge knuckles; a torsion spring mechanism in said long hinge knuckle for urging said hinge leaves together; means for nonrotatably fixing one end of said torsion spring mechanism remote from said short hinge knuckle in the end of said long hinge knuckle; a pintle, about which said long hinge knuckle pivots, nonrotatably supported in said short hinge knuckle and extending through said first anti-friction bushing, said pintle having means for fastening said pintle to the other end of said torsion spring mechanism and an external flange located in said long hinge knuckle; a shoulder in the long hinge knuckle positioned a distance from said flange of said pintle; and a second anti-friction bushing disposed about said pintle in said long hinge knuckle, said second anti-friction bushing including an external flange positioned between said flange of said pintle and said shoulder.

26. A hinge according to claim 23, further comprising a smooth metallic washer interposed between said flange of said first anti-friction bushing and said short hinge knuckle.

27. A non-handed two knuckle spring hinge comprising a pair of adjacent hinge leaves, long and short axially aligned hinge knuckles formed respectively on adjacent edges of said leaves; a first anti-friction washer positioned between said hinge knuckles; a torsion spring mechanism in said long hinge knuckle for urging said hinge leaves together; means for nonrotatably fixing one end of said torsion spring mechanism remote from said short hinge knuckle in the end of said long hinge knuckle; a pintle, about which said long hinge knuckle pivots, nonrotatably supported in said short hinge knuckle and extending through said first anti-friction washer, said pintle having means for fastening said pintle to the other end of said torsion spring mechanism and an external flange located in said long hinge knuckle; a shoulder in the long hinge knuckle positioned a distance from said flange of said pintle; a second anti-friction washer disposed about said pintle between said flange of said pintle and said shoulder; and an anti-friction bushing disposed about said pintle between said first anti-friction washer and said second anti-friction washer.

28. A hinge according to claim 27, further comprising a smooth metallic washer interposed between said first anti-friction washer and said short hinge knuckle.

29. A two knuckle hinge comprising a pair of axially aligned hinge knuckles formed respectively on adjacent edges of two hinge leaves, an axially extending bore in each said knuckle, attachment means for the leaves adapted to be used to attach them to a door and a jamb, one of the hinge leaves adapted to be attached to either of said door or jamb and the other of said hinge leaves adapted to be attached to the other of said door or jamb; a pintle, about which one of said pair of hinge knuckles pivots, supported in the other of said pair of hinge knuckles against axial movement; a flange on said pintle, said flange being located in said bore of said one hinge knuckle; a bushing non-rotatably fixed in the bore of said one hinge knuckle generally coaxially therewith and between said flange and said other hinge knuckle, wherein the end of said bushing remote from said other hinge knuckle forms with said flange a thrust bearing for said hinge; and thrust bearing surfaces on the abutting ends of said hinge knuckles to form another thrust bearing for the hinge, whereby the hinge may be used interchangeably in left-handed and right-handed door installations and inverted in either type of installation without affecting the operation of the hinge.

30. A hinge according to claim 29, further comprising a torsion spring mechanism in said one hinge knuckle for urging said hinge leaves together, means for nonrotatably fixing one end of said torsion spring mechanism remote from said other hinge knuckle in said one hinge knuckle, means for fastening said pintle to the other end of said torsion spring mechanism, and means for nonrotatably supporting said pintle in said other hinge knuckle.

* * * * *